US009874427B2

(12) United States Patent
Karlsson et al.

(10) Patent No.: US 9,874,427 B2
(45) Date of Patent: Jan. 23, 2018

(54) CONTAINER FOR PACKAGING AND STORING AMMUNITION UNITS, A UNIT CARGO COMPRISING SUCH CONTAINERS AND A METHOD FOR PACKAGING AND STORING SUCH CONTAINERS

(71) Applicant: SAAB AB, Linköping (SE)

(72) Inventors: Per Karlsson, Örebro (SE); Thomas Widlund, Karlskoga (SE); Magnus Rådman, Väse (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 15/038,817

(22) PCT Filed: Dec. 4, 2013

(86) PCT No.: PCT/SE2013/000188
§ 371 (c)(1),
(2) Date: May 24, 2016

(87) PCT Pub. No.: WO2015/084219
PCT Pub. Date: Jun. 11, 2015

(65) Prior Publication Data
US 2016/0377400 A1 Dec. 29, 2016

(51) Int. Cl.

| | |
|---|---|
| ***F42B 39/24*** | (2006.01) |
| ***F42B 39/14*** | (2006.01) |
| ***F42B 39/26*** | (2006.01) |
| ***B65B 61/20*** | (2006.01) |

(52) U.S. Cl.
CPC ..... *F42B 39/24* (2013.01); *B65B 61/202* (2013.01); *F42B 39/14* (2013.01); *F42B 39/26* (2013.01)

(58) Field of Classification Search
CPC ..... B65B 61/20; B65B 61/202; F42B 33/06; F42B 37/00; F42B 39/00; F42B 39/14; F42B 39/24; F42B 39/26
USPC ..... 53/410; 86/47–50; 206/3, 443, 446, 821
See application file for complete search history.

(56) References Cited

U.S. PATENT DOCUMENTS

| | | | | |
|---|---|---|---|---|
| 3,635,330 A | | 1/1972 | Merrick et al. | |
| 3,757,933 A | | 9/1973 | Banta | |
| 4,286,708 A | | 9/1981 | Porzel | |
| 4,291,803 A | * | 9/1981 | Perales | B65D 59/02 206/443 |
| 4,356,913 A | * | 11/1982 | Moraine | F42B 39/26 206/3 |
| 4,566,588 A | | 1/1986 | Kataczynski | |
| 4,850,260 A | | 7/1989 | Walker et al. | |

(Continued)

FOREIGN PATENT DOCUMENTS

WO WO 2014189380 A1 * 11/2014 ..... F42B 39/14

OTHER PUBLICATIONS

PCT/ISA/210—International Search Report—dated Jul. 28, 2014 (Issued in Application No. PCT/SE2013/000188).

(Continued)

*Primary Examiner* — Bryon Gehman
(74) *Attorney, Agent, or Firm* — Venable LLP; Jeffri A. Kaminski

(57) ABSTRACT

A container for packaging and storing ammunition units in tubes. A unit cargo includes such containers. A method for packaging and storing such containers. T-shaped detonation protections are introduced to separate adjacent tubes in order to prevent mass detonation.

15 Claims, 5 Drawing Sheets

(56) References Cited

U.S. PATENT DOCUMENTS

| | | | | |
|---|---|---|---|---|
| 4,878,415 | A | 11/1989 | Foster, Jr. et al. | |
| 6,779,654 | B1 * | 8/2004 | Marquis | F42B 39/26 206/3 |
| 7,416,076 | B2 * | 8/2008 | Barton | F42B 39/00 206/3 |
| 7,546,917 | B1 | 6/2009 | Lam et al. | |
| 8,210,346 | B2 * | 7/2012 | Johnson | F42B 39/24 206/317 |
| 8,931,633 | B2 * | 1/2015 | Martin, III | F42B 39/26 206/3 |
| 2009/0107854 | A1 | 4/2009 | Toreheim et al. | |
| 2014/0124387 | A1 * | 5/2014 | Iannello | F42B 39/02 206/3 |

OTHER PUBLICATIONS

PCT/ISA/237—Written Opinion of the International Searching Authority—dated Jul. 28, 2014 (Issued in Application No. PCT/SE2013/000188).

* cited by examiner

CONTAINER FOR PACKAGING AND STORING AMMUNITION UNITS, A UNIT CARGO COMPRISING SUCH CONTAINERS AND A METHOD FOR PACKAGING AND STORING SUCH CONTAINERS

A container for packaging and storing ammunition units, a unit cargo comprising such containers and a method for packaging and storing such containers.

CROSS-REFERENCE TO RELATED APPLICATIONS

The application is the national phase under 35 U.S.C. §371 of PCT/SE2013/000188 filed 4 Dec. 2013.

TECHNICAL FIELD

The present invention relates to a container for packaging and storing ammunition units such as rounds to prevent mass detonation, comprising a plurality of tubes arranged side by side for storing an ammunition unit each. The invention also refers to a unit cargo comprising a plurality of such containers and a method for packaging and storing ammunition units such as rounds using tubes to store an ammunition unit in each tube.

BACKGROUND

Containers for packaging and storing ammunition units of the type defined above are previously known and it can for example be referred to U.S. Pat. Nos. 3,757,933 and 7,546,917 both disclosing embedded tubs to store ammunition units.

In particular within the area of Insensitive Munitions (IM) there is a desire and requirement to protect weapon systems from external threats and in particular threats that can result in mass detonation. In order to estimate the IM-ability of a weapon system there are today available a number of standardized tests and standardized threats. Our proposed container solution has been designed to prevent mass detonation when testing "Sympathetic Reaction" (SR) according to a set standard.

The containers disclosed in the above cited US patents are not considered to fulfil now set standards.

SUMMARY OF THE INVENTION

The main object of the invention is to obtain a container, an unit cargo and a method that fulfil set standards for preventing mass detonation and effectively avoid mass detonation. Another object is to provide a non-complicated and cost effective solution avoiding mass detonation.

The objects are obtained by a container according to the first paragraph characterized in that the comprised tubes are connected in pairs, that each tube pair is separated by a T-shaped detonation protection arranged with the base of the T-shape extending into a space between the tubes of a pair and with the top section of the T-shape arranged to separate the tube pair from adjacent tube pairs. The T-shaped detonation protections effectively prevent pressure from a detonating ammunition unit to reach and detonate adjacent ammunition units.

Preferably the T-shaped detonation protections are of high density materials and for example metallic material. One such suitable material is steel.

According to one proposed embodiment the container is characterized in that at least two tube pairs are comprised in the container and that the top section of a T-shaped detonation protection of each tube pair are parallel and face each other. In particular it is proposed that three tube pairs are comprised in the container. In this connection it is in particular proposed that top sections of T-shaped detonation protections facing each other are separated by a compressible plate attached to the top section of one of the two top sections facing each other. The combining of T-shaped detonation protections creates an effective protection and facilitates an uncomplicated assembling. By the introduction of the compressible plate undesired rattling is avoided. In particular it is proposed that the compressible plate is of plastazote In a further proposed development of the container, each comprised pairs of tubes is separated by a distance plate. This insertion of distance plates still more facilitates the packaging of the container. Suitably the distance plate is provided with a foot at a bottom section of the plate and a recess in the plate to accommodate the top section of the T-shaped detonation protection. By this embodiment the tube pairs are easily kept in position when packaging and the positioning of the T-shaped detonation protections are well defined relative to warheads of the ammunition units. One suitable material proposal for the distance plate is that it is made of foamed plastic such as polyethylene.

Preferably the T-shaped detonation protections are located in close connection to warheads of the ammunition units stored in the tubes.

The present invention also relates to a unit cargo comprising containers according to the above stapled on a pallet in a plurality of layers, each layer comprising a plurality of containers. According to one proposal there are three layers comprised, each layer comprising three containers. A unit cargo as defined is easily transportable and has a high resistance towards mass detonation. The high resistance towards mass detonation is primary due to the design and locating of T-shaped detonation protections built in.

Furthermore the invention relates to a method for packaging and storing ammunition units such as rounds using tubes to store an ammunition unit in each tube. The following method packaging steps are carried out:

a) manufacturing tubes connected in pairs,
b) filling the tubes with an ammunition unit in each tube,
c) introducing a T-shaped detonation protection with the base of the T-shape extending into a space between the connected tubes of a pair,
d) inserting the tube pairs into a box while supporting the connected tube pairs by insertion of distance plates.

BRIEF DESCRIPTION OF THE DRAWINGS

The invention will now be described in more detail with reference to the accompanying drawings in which.

DETAILED DESCRIPTION

Figure 1:
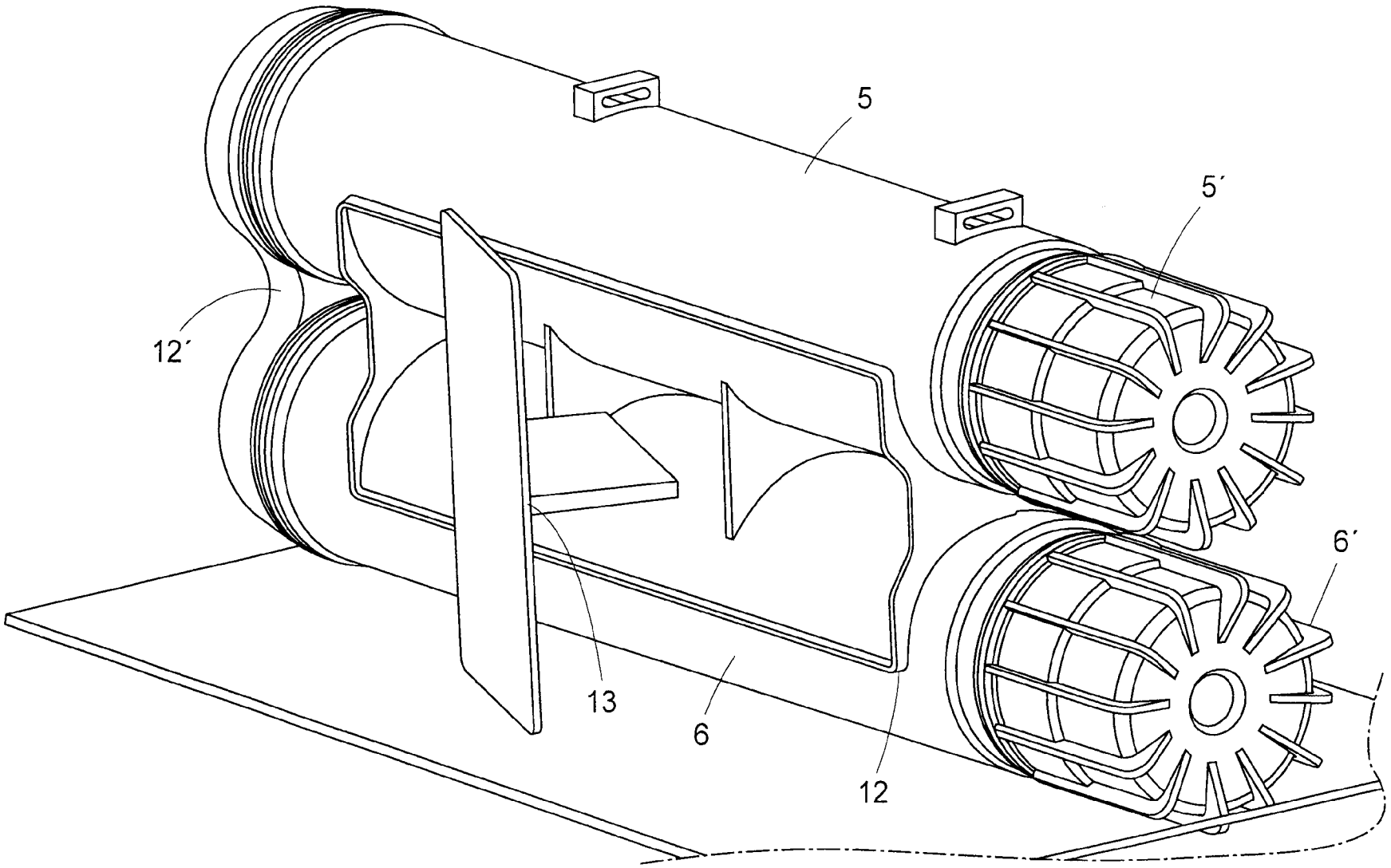
FIG. 1 schematically shows a pair of tubes having ammunition units installed and suitable for packaging according to the invention.

According to FIG. 1 two tubes 5, 6 are shown with a round 5' inserted in tube 5 and a round 6' inserted in tube 6. The tubes are connected by connecting elements 12 and 12'. Preferably, the tubes are manufactured as a connected pair already when originally manufactured. Furthermore, a T-shaped detonation protection 13 is shown and its arrangement will be further described below.

An example of a container for packaging and storing ammunition according to the invention will now be described with reference to FIGS. 2*a*, 2*b* and partly FIG. 5. The shown container 1 is intended to house six tubes in a box 2 shown with top cover and two side walls removed in FIGS. 2*a* and 2*b*. In the shown example four tubes 3, 4, 5 and 6 (reference 4 shown in FIG. 5) have been inserted. The tubes are connected in pairs so that the tubes 3 and 4 form a first tube pair 9 and the tubes 5 and 6 form a second tube pair 10 and tubes 7 and 8 referenced in FIG. 5 form a third tube pair 11. The tube pairs are connected by connecting elements 12 and 12', see FIGS. 2*a* and 2*b*. Each tube 3-8 is adapted to accommodate an ammunition unit such as a separate round 3', 4', 5', 6', 7' and 8'.

Figure 2A:
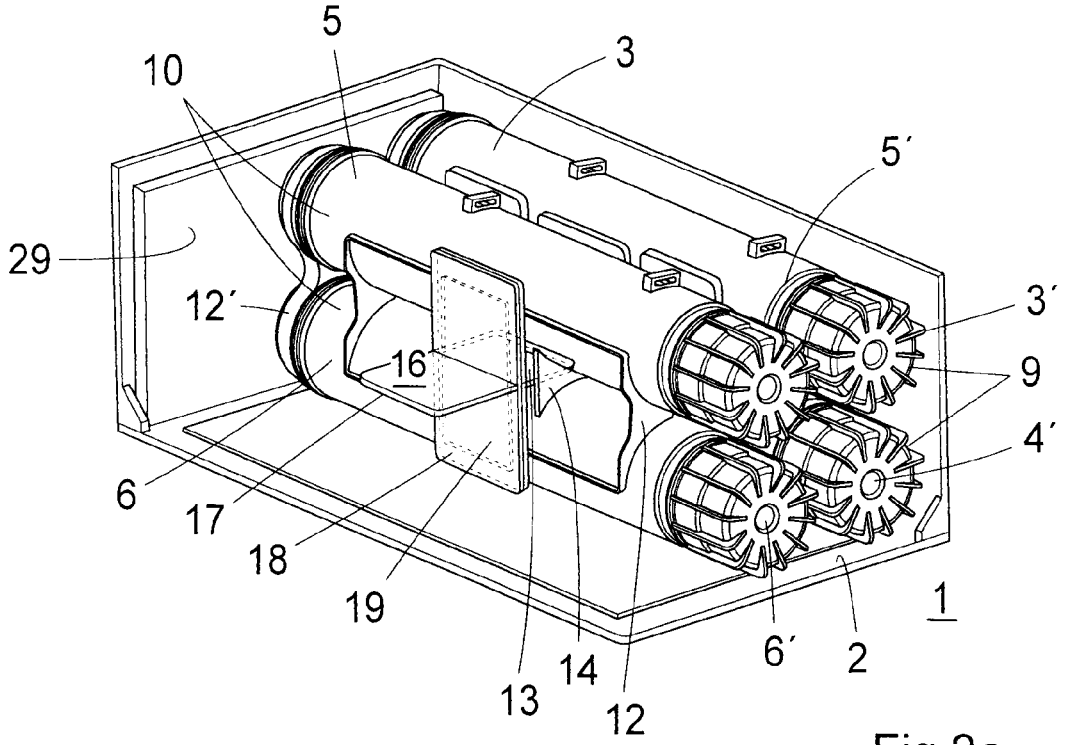
FIG. 2*a* schematically illustrates an example of a container for packaging and storing ammunition units according to the invention adapted for six ammunition units and containing four ammunition units in place.
Figure 3:
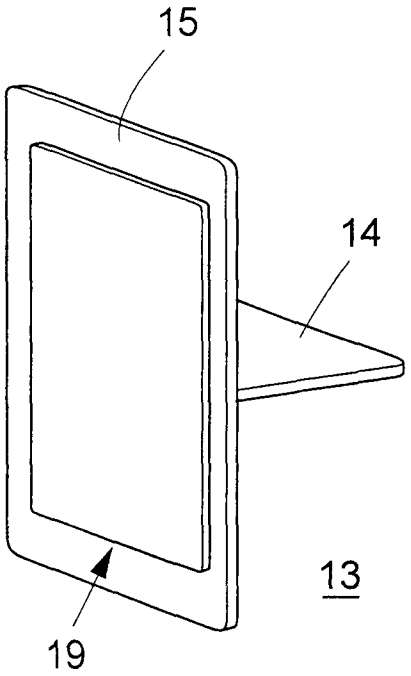
FIG. 3 schematically shows one example of a T-shaped detonation protection comprised in the container according to the invention.
Figure 4:
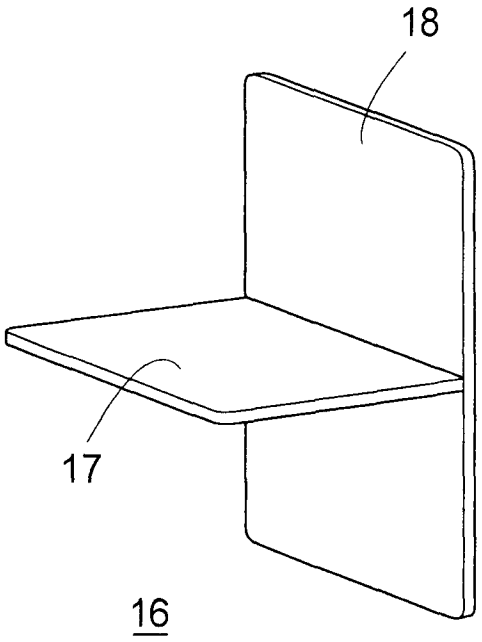
FIG. 4 schematically shows another example of T-shaped detonation protection comprised in the container according to the invention.

In order to prevent mass detonation T-shaped detonation protections are introduced between adjacent tubes. An example of a first type T-shaped detonation protection 13 is shown in FIG. 2*a* and FIG. 3. The detonation protection has a base 14 and a top section 15. As shown in FIG. 3 the T-shaped detonation protection is provided with a compressible plate 19 attached to the top section 15. A suitable material choice for the compressible plate is plastazote. A similar second type T-shaped detonation protection is denoted 16 and is shown in FIGS. 2*a*, 2*b* and 4. In accordance with detonation protection 13, detonation protection 16 has a base 17 and a top section 18. The T-shaped detonation protections 13, 16 are preferably of metallic materials having high density, such as steel.

Figure 5:
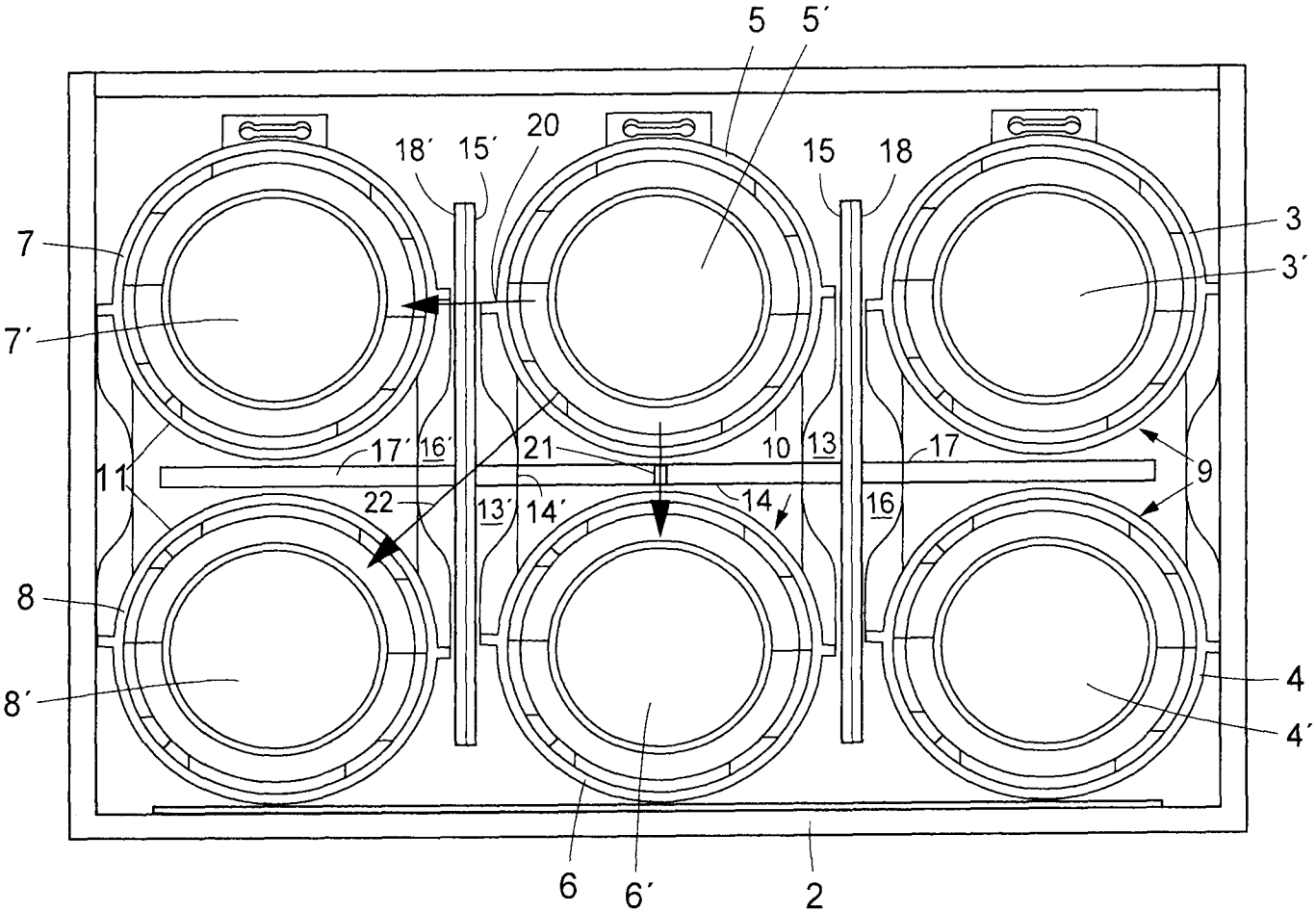
FIG. 5 schematically shows a container with six ammunition units such as rounds with inserted T-shaped detonation protections and illustrates forces exerted by a detonating ammunition unit on adjacent ammunition units.

In FIG. 5 it is schematically shown how the T-shaped detonation protections could be arranged in a container 1 accommodating six tubes 3-8 divided into three pairs, each tube housing a round 3'-8'. The arrangement comprises two T-shaped detonation protections 13, 13' of a first type and two T-shaped detonation protections of a second type 16, 16'. The T-shaped detonation protections are preferably located close to the not shown warheads of the rounds. Commonly this means that the T-shaped detonation protections 13, 16, 13', 16' are located to the middle part of the longitudinal extension of the tubes 3-8 as shown in the FIGS. 2*a* and 2*b*. In the shown container 1 of FIG. 5, round 5' is assumed to detonate and arrows indicate the influence on adjacent rounds. These arrows illustrate how pressure and splinter fragmentation from round 5' act horizontally, arrow 20, vertically, arrow 21, and diagonally, arrow 22. The length of the arrows indicates the strength. The arrangement of T-shaped detonation protections 13, 16 effectively prevents detonation to be transmitted between the rounds in the container in the case of one round in the container being initiated to detonation. An essential advantage is that the detonation protection built up with T-shaped detonation protections and arranged in accordance with the invention offers the best protection diagonally where the stress is as highest.

Figure 2B:
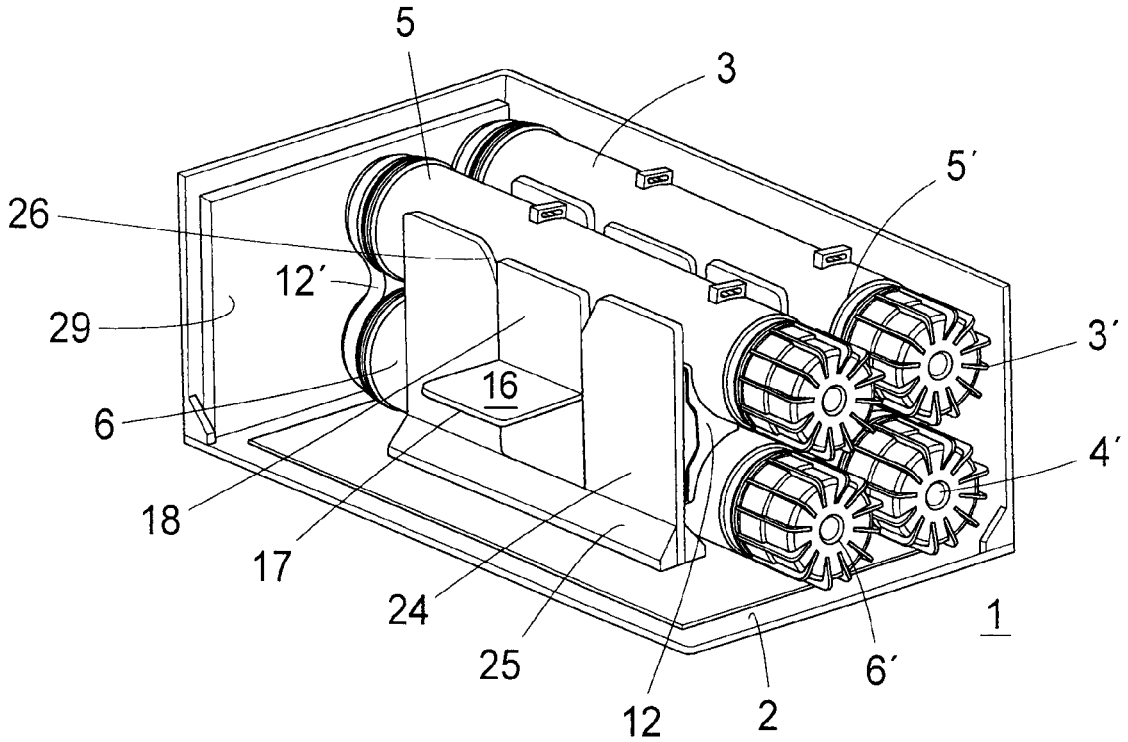
FIG. 2*b* schematically illustrates the container of FIG. 2*a* in a subsequent packaging step comprising another distance plate.

In order to facilitate the packaging of the container 1 a distance plate 24 as shown in FIG. 2*b* can be inserted. The distance plate is provided with a foot 25 at the bottom section of the distance plate and provided with a recess 26 in a central section dimensioned to accommodate the top section 15 of a T-shaped detonation protection 13. The distance plate can be made of foamed plastics such as polyethylene.

Furthermore, a second type of distance plate 29, see FIGS. 2*a* and 2*b*, can be provided at the end walls of the box to further facilitate the packaging operation.

In the following a suitable packaging procedure is described with reference to FIGS. 2*a*, 2*b*, 3 and 4. Commonly the tubes are manufactured in pairs in advance of packaging. In this way the tubes 3 and 4 form a first pair, the tubes 5 and 6 form a second pair and the tubes 7 and 8 form a third pair. Each pair is connected by connecting elements 12 and 12'. Each pair of connected tubes is then filled with a round in each tube. This can also take place in advance or in immediate connection with a following packaging procedure as a first step. In a second step connected tubes 3 and 4 are separated by a T-shaped detonation protection 16 as shown in FIG. 4 by inserting the base 17 of the T-shaped detonation protection into a space between the connected tubes 3 and 4. Then the tubes 3 and 4 are inserted into the box 2 and held in position by a foot provided distance plate similar to distance plate 24. In a next step a T-shaped detonation protection 13 as shown in FIG. 3 is arranged in the box 2 with the top section 15 of the T-shaped detonation protection parallel with and facing the top section 18 of the T-shaped detonation protection 16 as shown in FIG. 4. In a next step the procedure is repeated for tubes 5 and 6 by inserting a T-shaped detonation protection 13 as shown in FIG. 3, inserting the tubes into the box 2 and providing a distance plate 24. Then a T-shaped detonation protection 17 as shown in FIG. 4 is inserted in the space between the tubes 7 and 8 and finally the tubes 7 and 8 are inserted into the box 2. The now filled box 2 is closed by applying a not shown lid.

Figure 6:
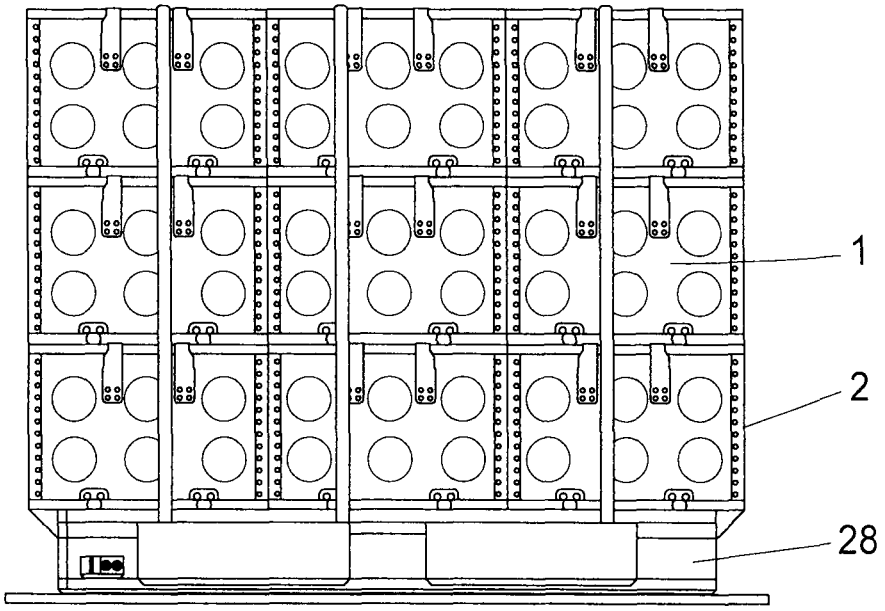
FIG. 6 schematically shows a unit cargo according to the invention comprising a plurality of containers according to the invention in a plurality of layers.

In FIG. 6 a unit cargo 27 is shown comprising a plurality of containers 1 in the shape of boxes 2 with adequate content. The boxes 2 are stapled on a pallet 28 in three different layers, each layer comprising three boxes.

The container, unit cargo and method of the invention is not limited to the examples described above but may be modified within the scope of the attached claims.

The invention claimed is:

1. A container for packaging and storing ammunition units, the container comprising:

a plurality of tubes arranged side by side for storing an ammunition unit each, wherein the tubes are connected in pairs, and a T-shaped detonation protection separating each tube pair, wherein the T-shaped detonation protection is arranged with a base of the T-shape extending into a space between the tubes of a tube pair and with a top section of the T-shape arranged to separate the tube pair from adjacent tube pairs.

2. The container according to claim 1, wherein the T-shaped detonation protections comprise a high density material.

3. The container according to claim 1, wherein the T-shaped detonation protections comprise metallic materials.

4. The container according to claim 3, wherein the T-shaped detonation protections comprise steel.

5. The container according to claim 1, wherein the container includes at least three tube pairs, and wherein the top sections of the T-shaped detonation protections of are parallel and face each other.

6. The container according to claim 1, wherein the container includes three tube pairs.

7. The container according to claim 6, further comprising:

a compressible plate attached to the top section of one of the two top sections facing each other, wherein the compressible plate separates facing top sections of T-shaped detonation protections.

8. The container according to claim 7, wherein the compressible plate comprises plastazote.

9. The container according to claim 1, further comprising:

a distance plate separating each pair of tubes.

10. The container according to claim 9, wherein the distance plate comprises a foot at a bottom section of the plate and a recess in the plate to accommodate respective top sections of the T-shaped detonation protections.

11. The container according to claim 9, wherein the distance plate comprises foamed plastic.

12. The container according to claim 1, wherein the T-shaped detonation protections are located in the vicinity of warheads of the ammunition units stored in the tubes.

13. A unit cargo, comprising:

a plurality of containers each comprising a plurality of tubes arranged side by side for storing an ammunition unit each, wherein the tubes are connected in pairs, and a T-shaped detonation protection separating each tube pair, wherein the T-shaped detonation protection is arranged with a base of the T-shape extending into a space between the tubes of a tube pair and with a top section of the T-shape arranged to separate the tube pair from adjacent tube pairs; and a pallet on which the containers are stapled in a plurality of layers, each layer comprising said plurality of containers.

14. The unit cargo as claimed in claim 13, wherein three layers are comprised, and wherein each layer comprises three containers.

15. A method for packaging and storing ammunition units using tubes to store an ammunition unit in each tube, the method comprising:

manufacturing tubes connected in pairs, filling the tubes with an ammunition unit in each tube, introducing a T-shaped detonation protection with the base of the T-shape extending into a space between the connected tubes of a pair, and inserting the tube pairs into a box while supporting the connected tube pairs by insertion of distance plates.

* * * * *